US009133806B2

(12) United States Patent
Gerstner

(10) Patent No.: US 9,133,806 B2
(45) Date of Patent: Sep. 15, 2015

(54) SHUTDOWN PRESSURE RELIEF VALVE FOR COMMON RAIL FUEL SYSTEM

(75) Inventor: Michael David Gerstner, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 691 days.

(21) Appl. No.: 13/480,920

(22) Filed: May 25, 2012

(65) Prior Publication Data

US 2013/0312702 A1 Nov. 28, 2013

(51) Int. Cl.

| | |
|---|---|
| ***F02B 3/00*** | (2006.01) |
| ***F02M 63/00*** | (2006.01) |
| *F02M 63/02* | (2006.01) |

(52) U.S. Cl.

CPC ..... *F02M 63/0028* (2013.01); *F02M 63/0052* (2013.01); *F02M 63/026* (2013.01); *F02M 63/025* (2013.01); *Y10T 137/7781* (2015.04)

(58) Field of Classification Search

CPC ..... Y02T 10/36; Y02T 10/32; F02M 55/025; F02D 41/3845; F02D 2200/0602

USPC ..... 123/456, 457, 459, 461, 506, 510, 511, 123/514, 299

See application file for complete search history.

(56) References Cited

U.S. PATENT DOCUMENTS

| | | | | |
|---|---|---|---|---|
| 3,665,950 | A | 5/1972 | Nelson | |
| 5,035,223 | A * | 7/1991 | Watanabe | 123/459 |
| 5,694,966 | A | 12/1997 | Holder | |
| 5,708,201 | A * | 1/1998 | Kaub | 73/114.42 |
| 2004/0163626 | A1 * | 8/2004 | Stockner et al. | 123/446 |
| 2010/0282212 | A1 | 11/2010 | Shafer et al. | |
| 2011/0125387 | A1 | 5/2011 | Suzuki et al. | |

* cited by examiner

*Primary Examiner* — Hai Huynh
*Assistant Examiner* — Gonzalo Laguarda

(57) ABSTRACT

A passive hydraulically actuated non-electric shutdown pressure relief valve relieves pressure in the high pressure volume of a low static leak common rail fuel system after shutdown. When the common rail fuel system is in operation, a transfer pump provides medium pressure to hold the shutdown pressure relief valve closed. At shutdown, the residual medium pressure downstream from the transfer pump decays back to tank, and the residual high pressure trapped in the common rail and fuel injectors pushes open the shutdown pressure relief valve to release the high pressure after back to tank.

11 Claims, 2 Drawing Sheets

SHUTDOWN PRESSURE RELIEF VALVE FOR COMMON RAIL FUEL SYSTEM

TECHNICAL FIELD

The present disclosure relates generally to low static leak common rail fuel systems, and more particularly to a shutdown pressure relief valve that releases high pressure from the common rail after shutdown.

BACKGROUND

Over the years, engineers have become more successful in reducing static leakage within common rail fuel systems. Reducing static leakage can improve performance, and efficiency, but is difficult to accomplish given the multitude of potential leak paths between the high pressure pump, common rail and valves within a plurality of fuel injectors for a common rail fuel system. While low static leakage is desirable, there is also a desire that all of the wetted volumes within a common rail fuel system return to atmospheric or tank pressure after the system is shutdown so that the risk of fuel spraying out of the system during servicing is reduced. While it is almost inconceivable that a common rail fuel system could be manufactured that had absolutely zero static leakage, the leakage in current systems may be so small that the decay of pressure in the high pressure volume can take an unacceptably long time to occur. Pressure decay times in excess of several minutes might be deemed unacceptable in the industry.

The present disclosure is directed toward one or more of the problems set forth above.

SUMMARY

A common rail fuel system includes a common rail fluidly positioned between a high pressure pump and a plurality of fuel injectors. A transfer pump is fluidly positioned between a tank and the high pressure pump. A high pressure volume is fluidly positioned between the high pressure pump and a pair of valves in each of the plurality of fuel injectors. A medium pressure volume is fluidly positioned between the transfer pump and the high pressure pump. A low pressure volume is fluidly positioned between the plurality of fuel injectors and the transfer pump. The shutdown pressure relief valve has a first port fluidly connected to the low pressure volume, a second port fluidly connected to the medium pressure volume and a third port fluidly connected to the high pressure volume. The shutdown pressure relief valve is pressure actuated to open and close a fluid connection between the first port and the third port, responsive to fluid pressure in the second port.

In another aspect, a method of shutting down a common rail fuel system includes stopping the transfer pump and the high pressure pump. Pressure from a medium pressure volume is allowed to decay. A fluid connection between the high pressure volume and a low pressure volume is opened through a shutdown pressure relief valve responsive to the pressure decay from the medium pressure volume.

In still another aspect, a shutdown pressure relief valve includes a housing that defines a cavity fluidly connected to a first port, a second port and a third port. A piston is positioned to divide the cavity into a first chamber and a second chamber, and is movable along a centerline. The first chamber is fluidly connected to the first port and to the third port through a valve seat. The second chamber is fluidly connected to the second port. A valve member is positioned in the first chamber, and movable between a closed position in contact with the valve seat and an open position out of contact with the valve seat. The piston has a large area hydraulic surface exposed to fluid pressure in second port. The valve member has a small area hydraulic surface exposed to fluid pressure in the third port when in the closed position.

DETAILED DESCRIPTION

Figure 1:
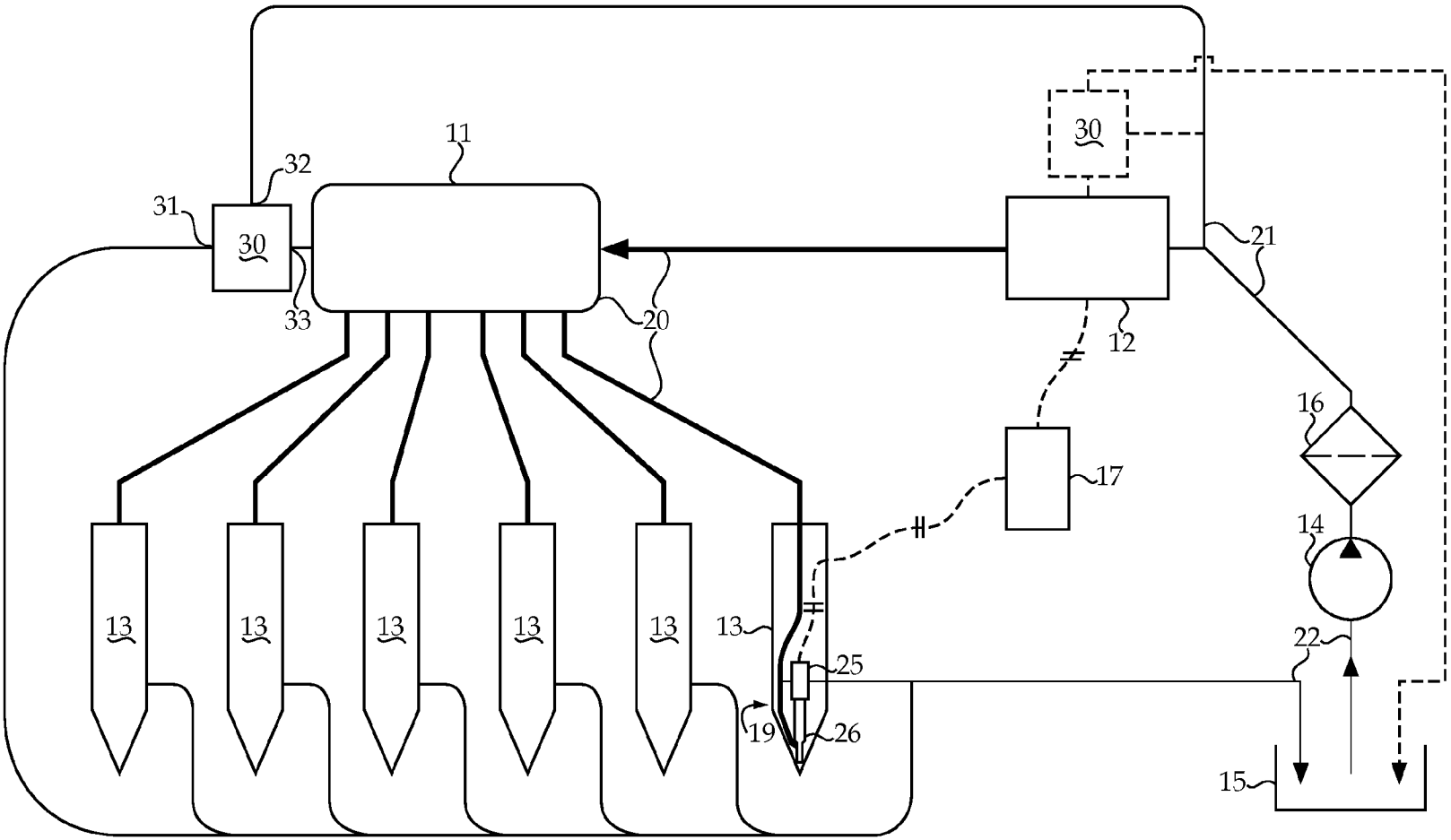
FIG. 1 is a schematic view of a common rail fuel system according to the present disclosure.

Referring to FIG. 1, a common rail system 10 includes a common rail 11 fluidly positioned between a high pressure pump 12 and a plurality of fuel injectors 13. A transfer pump 14 is fluidly positioned between a tank 15 and the high pressure pump 12. A high pressure volume 20 is fluidly positioned between the high pressure pump 12 and a pair of valves 19 in each of the plurality of fuel injectors 13. The pair of valves 19 may be a nozzle needle check valve 25 for opening and closing nozzle outlets to facilitate a fuel injection, and a control valve 26 that may control pressure on a closing hydraulic surface of the nozzle needle check valve 25 to control the timing of injection events. A medium pressure volume 21 is fluidly positioned between the transfer pump 14 and the high pressure pump 12. One or more filters 16 may be positioned in the medium pressure volume 21. A low pressure volume 22 is fluidly positioned between the plurality of fuel injectors 13 and the transfer pump 14. The tank 15 defines a substantial portion of the low pressure volume 22. The small amount of fuel utilized by the fuel injectors 13 for controlling injection events is returned to tank 15 via the low pressure volume 22. Common rail fuel system 10 may also include an electronic controller 17 that controls pressure in common rail 11, such as by controlling output from high pressure pump 12, and controls the timing and quantity of injection events, such as by controlling the action of control valve 25. A shut down pressure relief valve 30 has a first port fluidly connected to the low pressure volume 22, a second port 32 fluidly connected to the medium pressure volume 21, and a third port 33 fluidly connected to the high pressure volume 20. The shut down pressure relief valve 30 is preferably passive, hydraulically actuated and completely non-electric. The shut down pressure relief valve 30 is pressure actuated to open and close a fluid connection between the first port 31 and the third port 33 responsive to fluid pressure in the second port 32.

Those skilled in the art will appreciate that when common rail fuel system 10 is in operation, the transfer pump 14 continuously draws low pressure fuel from tank 15 and provides medium pressure fuel to the inlet of high pressure pump 12 while the engine (not shown) is running. The shut down pressure relief valve 30 utilizes the medium pressure that exists while the fuel system 10 is in operation to close the fluid connection between the first port 31 and the third port 33. At engine shut down, when the common rail fuel system 10 ceases operation, transfer pump 14 and high pressure pump 12 stop, and the medium pressure in medium pressure volume 21 decays back to tank 15. When this occurs, the residual high pressure in common rail 11 acts to open the third port to the first port to allow the residual pressure in the high pressure volume 20 to be released to the low pressure volume 22, which includes tank 15.

In FIG. 1, shut down pressure relief valve 30 is shown attached to one end of common rail 11. Also shown in dotted lines, is an alternative version in which the shut down pressure relief valve 30 may be relocated to be attached to a junction block associated with high pressure pump 12. Those skilled in the art will appreciate that the shut down pressure relief valve 30 can be located at any suitable location in common rail fuel system 10 without departing from the present disclosure.

Figure 2:
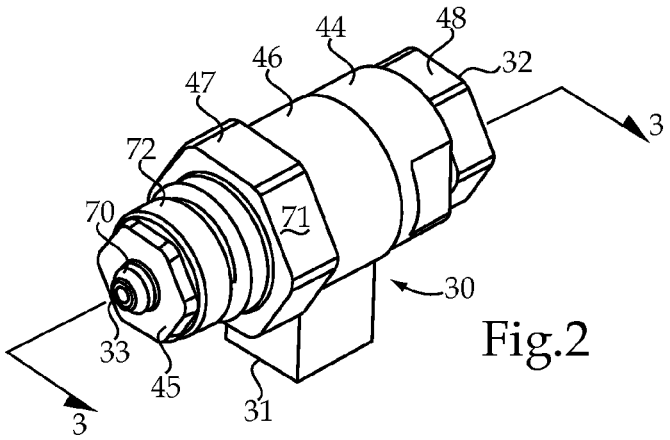
FIG. 2 is an isometric view of a shutdown pressure relief valve according to an aspect of the present disclosure.
Figure 3:
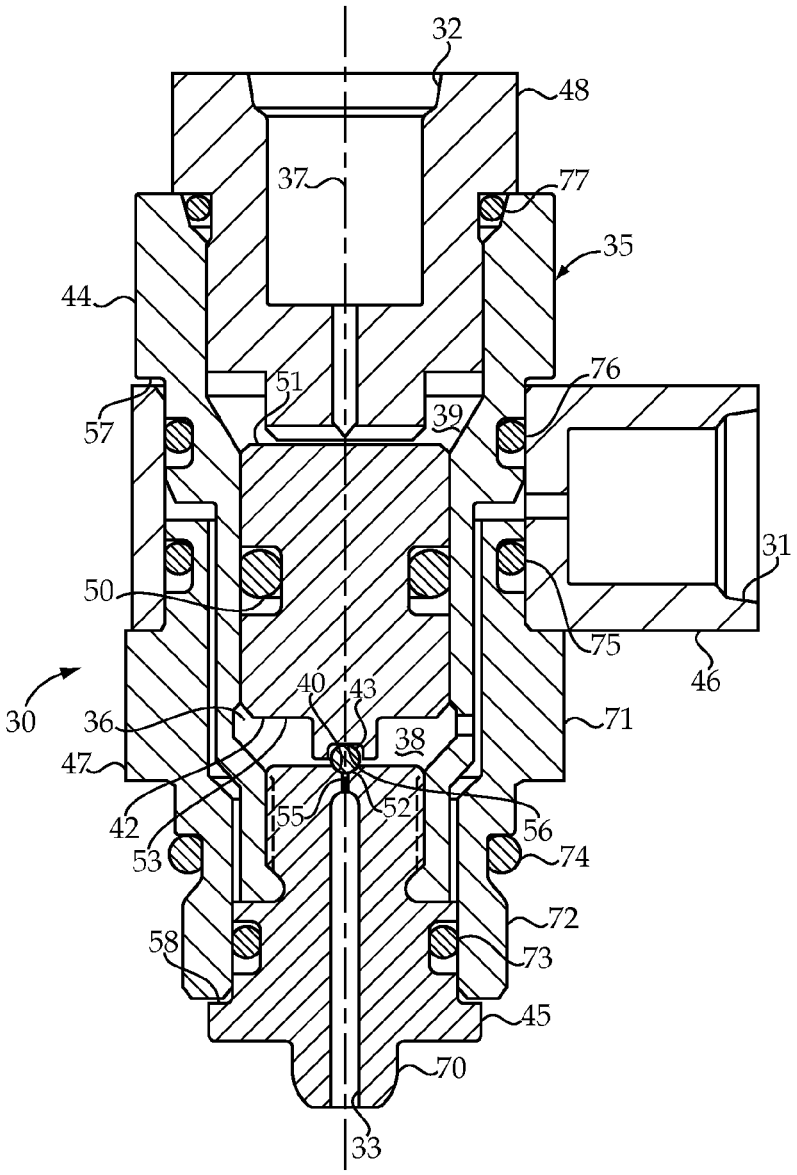
FIG. 3 is a sectioned side view through the shutdown pressure relief valve of FIG. 2 as viewed along section line 3-3.

Referring now to FIGS. 2 and 3, a shut down pressure relief valve 30 may include a housing 35 that defines a cavity 36 that is fluidly connected to the first port 31, the second port 32 and the third port 33. A piston 42 is positioned to divide cavity 36 into a first chamber 38 and a second chamber 39. Piston 42 is movable along a centerline 37. In the illustrated embodiment, piston 42 is unbiased (no mechanical springs), but a design that included a spring bias in either direction along centerline 37 would also fall within the intended scope of the present disclosure. The first chamber 38 is fluidly connected to the first port 31 and to the third port 33 through a valve seat 40. The second chamber 39 is fluidly connected to the second port 32. In the illustrated embodiment, the first chamber 38 is fluidly isolated from the second chamber 39 by the inclusion of an o-ring seal 50 mounted about piston 42. However, in some instances it might be desirable to omit seal 50 to allow some leakage of fuel from second chamber 39 toward first chamber 38 along the outside surface of piston 42. For instance this option might be attractive if seal 50 were to create too much uncertainty in the movement forces necessary to move piston 42 to properly operate shut down pressure relief valve 30.

A valve member 43 is positioned in the first chamber 38, and is movable between a closed position in contact with valve seat 40, and an open position out of contact with valve seat 40. In the illustrated embodiment, valve member 43 is a spherically shaped ball that contacts a conical valve seat 40. However, those skilled in the art will appreciate that other designs would fall within the scope of the present disclosure. For instance, one might substitute a known flat seat and counterpart valve member often associated with control valves of the type utilized in fuel injectors 13 in certain common rail applications. The piston 42 has a large area hydraulic surface 51 exposed to fluid pressure in second chamber 39 and hence to second port 32. The valve member 43 has a small area hydraulic surface 52 exposed to fluid pressure in the third port 33 when valve member 43 is in the closed position in contact with valve seat 40. Piston 42 includes an intermediate hydraulic surface 53 exposed to fluid pressure in second port 32. The small area hydraulic surface 52 and the intermediate hydraulic surface 53 are oriented in opposition to the large area hydraulic surface 51.

Housing 35 may include a hollow body 44, a valve seat component 45 and a banjo fitting 46. The valve seat component 45 may define an orifice 55 fluidly positioned between valve seat 40 and the third port 33. The flow area of orifice 55 may define the rate at which fluid pressure in the high pressure volume 20 is released toward first port 31 when valve member 43 is lifted off of valve seat 40. Also shown as optional is the inclusion of a possible edge filter 78 in the third port 33. The banjo fitting 46 defines first port 31 and has one of a continuum of neutral orientations around centerline 37. This structure allows free rotation of banjo fitting 46 and may ease in installation and make shut down pressure relief valve 30 versatile for use across several different common rail fuel systems with different geometries and spatial constraints. In order to allow for some misalignment between valve seat 40 and the movement line of piston 42, the piston may contact the valve member 43 at an alignment neutral location of a planar surface 56 oriented perpendicular to centerline 37. Thus, the centerline 32 of valve seat 40 may be slightly off center with the line along which piston 42 moves, such that one or both are slightly displaced from centerline 37. However, by choosing the structure shown, the operation of shut down pressure relief valve 30 can be desensitized to any minor misalignments in this regard.

In the illustrating embodiment, a load nut 47 and the banjo fitting 46 are trapped between a shoulder 57 of hollow body 44 and a shoulder 58 of valve seat component 45. O-rings 75 and 76 may seal against leakage between banjo fitting 46 and load nut 47 and hollow body 44, respectively. Load nut 47 may include a set of external threads 72 that interact with the mounting location in common rail fuel system 10 (e.g., end of common rail 11 or junction block associated with high pressure pump 12) to avoid the inclusion of threads on valve seat component 45. Thus, when a tool is used to engage tool engagement surface 71 of load nut 47, the resulting force can push down on shoulder 58 and allow a rounded end 70 to be pushed into a counterpart seat of the mounting location (not shown) to form a fluid tight seal of a type well known in the art. Shut down pressure relief valve 30 may also include an o-ring 73 to provide a seal between valve seat component 45 and load nut 47. In addition, an o-ring 74 might also be included to provide a seal where shut down pressure relief valve 30 interacts with a mounting feature in common rail fuel system 10. Finally, shut down pressure relief valve 30 may include a port fitting 48 that defines second port 32. In the illustrated embodiment, depending upon whether edge filter 78 and/or o-ring seal 50 are included, the shut down pressure relief valve 30 includes exactly twelve to fourteen parts. Because of the interaction between valve member 43 and piston 42 is desensitized to misalignments, and for other reasons known in the art, shut down pressure relief valve 30 may not need to include any category parts. Those skilled in the art will appreciate that a category part is one that comes in several different sizes to compensate for different tolerance build ups in different assemblies. In the illustrated structure, further flexibility is provided by the ability of the load nut 47 to be free to rotate with respect to hollow body 44 and banjo fitting 46 about centerline 37.

The load nut 47 and the banjo fitting 46 are free to rotate and slide slightly up and down between the valve seat component 45 and the hollow body 44 in the illustrated embodiment. Outlet fitting 48 and valve seat component 45 may be threadably attached to hollow body 44. The illustrated structure allows the shut down pressure relief valve 30 to be connected to a high pressure port in common rail fuel system 10 without rotating the sealing surfaces against each other during tightening. In addition, the low pressure port 31 may then be oriented in any direction around centerline 37.

INDUSTRIAL APPLICABILITY

The present disclosure finds potential application in any common rail fuel system. The present disclosure finds particular application in common rail fuel systems with low static leakage. The present disclosure finds specific application in high pressure common rail fuel systems with low static leakage associated with compression ignition engines.

When common rail fuel system 10 is in operation, medium pressure from medium pressure volume 21 is transmitted to second port 32 and acts upon large area hydraulic surface 51 of piston 42. By appropriately sizing the small area hydraulic surface 52 of valve member 43, and taking in to account the expected pressure in high pressure volume 20 during normal operation, the medium pressure acting on piston 42 should be sufficient to hold valve member 43 in its closed position in contact with valve seat 40 to close the fluid connection between third port 33 and first port 31. As such, no significant leakage should occur through shut down pressure relief valve 30 when the common rail fuel system is in normal operation. When the associated engine is shut down and the common rail fuel system 10 is also shut down, the transfer pump 14 and the high pressure pump 12 will be stopped. Pressure in the medium pressure volume 21 will then quickly decay back to tank 15 (low pressure volume 22), such as through transfer pump 14. When this pressure drop occurs, the pressure force acting on large area hydraulic surface 51 is relieved. Eventually, the pressure will drop low enough that the residual high pressure in high pressure volume 20 will hydraulically push on the small area hydraulic surface 52 of valve member 43 causing it to move upward along centerline 37 out of contact with valve seat 40 to open the fluid connection between third port 33 and first port 31. This allows the residual high pressure and high pressure volume 20 to escape to low pressure volume 22. Depending upon the sizing of orifice 55, engineers can control the rate at which this pressure release occurs. For instance, it might be desirable for the residual high pressure, which may be in excess of 250 MPa to occur over a duration less than maybe two minutes. However, this time period is clearly a matter of design choice. For instance, one could expect that the medium pressure output from transfer pump 14 to be on the order of maybe 550 KPa, and pressure in the low pressure volume 22 to be on the order of 0 to maybe 50 KPa greater than atmospheric pressure. When transfer pump 14 stops, one could expect the medium pressure to decay back toward tank 15 in a matter measured in seconds rather than minutes.

The structure of the shut down pressure relief valve 30 illustrated allows great flexibility for use of one valve across many different common rail fuel systems 10. In addition, the structure allows for mounting valve 30 at virtually any location around or in common rail fuel system 10 that facilitates the necessary fluid connections to the first, second and third ports 31-33. For instance, the shut down pressure relief valve could be mounted at one end of a conventional common rail, in one of the blocks that comprise a daisy chain type common rail fuel system, attached to an accumulator in a common rail fuel system or even in a junction block associated with or in proximity to high pressure pump 12. In the illustrated design, valve 30 is passive such that as long as an engine is turning and the common rail fuel system 10 is operating, the transfer pump 14 can generate enough pressure to keep valve member 43 in its closed position. Once the engine stops rotating, the transfer pump 14 stops and the pressure on top of the piston 42 is relieved, allowing the valve member 43 and piston 42 to be pushed upward by the high pressure fuel in high pressure volume 20 to release the residual fuel pressure. Thus, provided a service technician waits some minimum prescribed time, determined by the size of orifice 55, the fuel system 10 can be serviced and opened without residual high pressure fuel being sprayed when system 10 is being serviced after an engine and common rail fuel system 10 has been shut down.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A common rail fuel system comprising:

a common rail fluidly positioned between a high pressure pump and a plurality of fuel injectors;

a transfer pump fluidly positioned between a tank and the high pressure pump;

a high pressure volume fluidly positioned between the high pressure pump and a pair of valves in each of the plurality of fuel injectors;

a medium pressure volume fluidly positioned between the transfer pump and the high pressure pump;

a low pressure volume fluidly positioned between the plurality of fuel injectors and the transfer pump;

a shutdown pressure relief valve with a first port fluidly connected to the low pressure volume, a second port fluidly connected to the medium pressure volume, and a third port fluidly connected to a high pressure volume; and the shutdown pressure relief valve being pressure actuated to open and close a fluid connection between the first port and the third port responsive to fluid pressure in the second port.

2. The common rail fuel system of claim 1 wherein the shutdown pressure relief valve includes a movable piston and valve member with a large area hydraulic surface exposed to fluid pressure in the medium pressure volume, an intermediate hydraulic surface exposed to fluid pressure in the low pressure volume, and a small area hydraulic surface exposed to fluid pressure in the high pressure volume; and the small area and intermediate hydraulic surfaces are oriented in opposition to the large area hydraulic surface.

3. The common rail fuel system of claim 2 wherein the shutdown pressure relief valve is attached to the common rail.

4. The common rail fuel system of claim 2 wherein the shutdown pressure relief valve is attached to the high pressure pump.

5. The common rail fuel system of claim 2 wherein the shutdown pressure relief valve includes a hollow body within which the piston and valve member move along a centerline of the body; and the first port being defined by a banjo fitting mounted around the hollow body in one of a continuum of neutral orientations about the centerline.

6. The common rail fuel system of claim 5 wherein the piston is in contact with, but unattached to, the valve member at an alignment neutral location of a planar surface oriented perpendicular to the centerline.

7. The common rail fuel system of claim 1 wherein the pair of valves of each of the plurality of fuel injectors are a nozzle needle check valve and a control valve.

8. A method of shutting down a common rail fuel system with a high pressure volume fluidly positioned between a high pressure pump and a pair of valves in each of the plurality of fuel injectors; a medium pressure volume fluidly positioned between a transfer pump and the high pressure pump; and a low pressure volume fluidly positioned between a tank and the transfer pump, the method comprising the steps of:

stopping the transfer pump and the high pressure pump;

decaying pressure from the medium pressure volume;

opening a fluid connection between the high pressure volume and the low pressure volume through a shutdown pressure relief valve responsive to the decaying step.

9. The method of claim 8 wherein the opening step includes hydraulically pushing a valve member of the shutdown pressure relief valve off of a seat with pressure in the high pressure volume.

10. The method of claim 9 wherein the opening step includes relieving pressure on a hydraulic surface of a piston that is in contact with the valve member.

11. The method of claim 10 wherein the decaying step includes releasing pressure from the medium pressure volume to the low pressure volume through the transfer pump.

* * * * *